United States Patent [19]

Hasselmann

[11] 4,295,504

[45] Oct. 20, 1981

[54] GASOLINE VAPOR RECOVERY SYSTEM

[76] Inventor: Detlev E. M. Hasselmann, 519 S. Nardo Ave., Solana Beach, Calif. 92075

[21] Appl. No.: 106,676

[22] Filed: Dec. 26, 1979

[51] Int. Cl.[3] ..... B65B 3/04; B67C 5/377

[52] U.S. Cl. ..... 141/290; 141/392

[58] Field of Search ..... 141/206-229, 141/285-310, 59, 1, 84, 339, 392; 251/282; 137/100, 269; 222/575; 29/157 C; 138/37, 39

[56] References Cited

U.S. PATENT DOCUMENTS 4,057,085 11/1977 Shihabi ..... 141/301

4,204,563 5/1980 Pyle ..... 141/392

*Primary Examiner*—Houston S. Bell, Jr.

*Attorney, Agent, or Firm*—Brown & Martin

[57] ABSTRACT

The valve in the vapor recovery conduit of a gasoline dispenser system is located between the hose portion of the vapor recovery conduit and the rigid portion thereof to free the nozzle of all valves and to make room for a retainer spring on the nozzle, thereby substantially reducing the weight of the nozzle, making it easier to handle, and protecting the valve from wear. A long nozzle sealing the boot which provides a good vapor seal with light pressure (e.g. 15 pounds) eliminates the need for an interlock on the nozzle.

5 Claims, 3 Drawing Figures

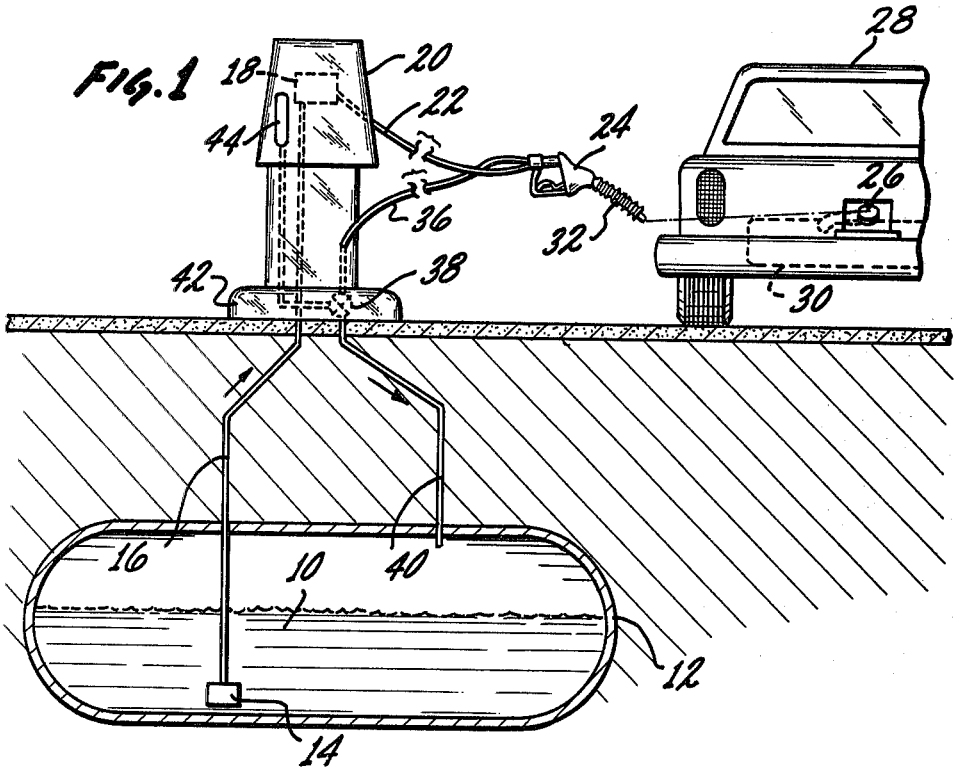
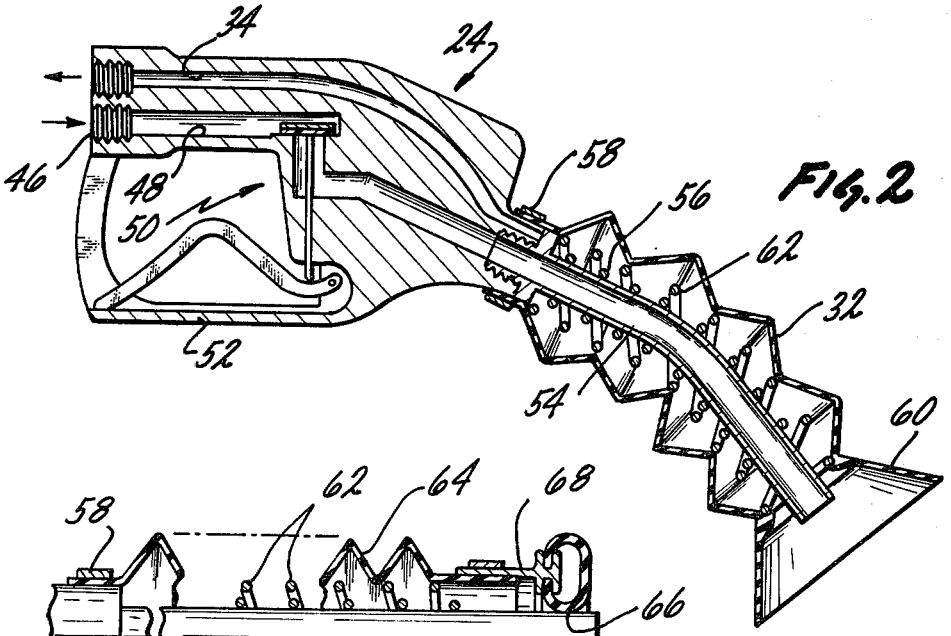
FIG. 2
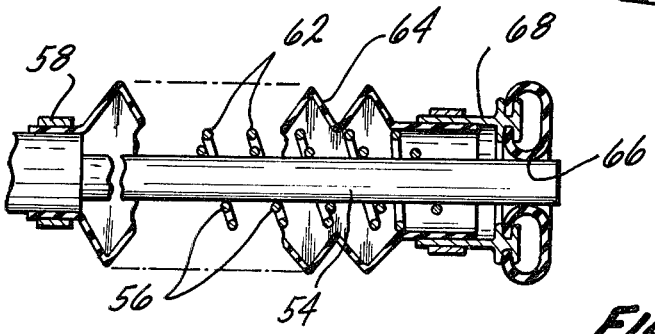
FIG. 3

GASOLINE VAPOR RECOVERY SYSTEM

BACKGROUND OF THE INVENTION

This invention relates to the recovery of gasoline vapors from gasoline dispenser systems.

As smog conditions have gone from bad to worse in larger cities, every effort has been made to reduce the amount of hydrocarbons released into the atmosphere from all sources. One relatively large source of atmospheric hydrocarbons is gasoline vapors being expelled from the gasoline tanks of automobiles when they are being refueled. Before being refueled, the nearly empty gasoline tank is filled with gasoline vapor. As gasoline is pumped into the empty gasoline tank, the gasoline vapor is pushed out of the tank and into the atmosphere through the clearance between the refueling nozzle and the gasoline inlet opening. Gasoline vapor released into the atmosphere in this manner can amount to 15% of the total hydrocarbons released from the tailpipes of automobiles and trucks. Therefore, in recent years, efforts have been made to develop vapor recovery systems for preventing the gasoline vapors from being released into the atmosphere during refueling.

Basically, these systems involve creating a vapor seal over the gasoline inlet opening when the refueling nozzle is inserted therein and providing a vapor recovering conduit which extends from the nozzle to the gasoline underground storage tank so that the gasoline vapors are pushed or drawn into the storage tank during the refueling instead of being released into the atmosphere.

There are two different types of vapor recovery systems: The balanced system and the vacuum-assist system. The balanced system relies on the push exerted by gasoline entering the gasoline tank and displacing the gasoline vapor which had previously filled with tank. This push is sufficient to move the vapors down the vapor recovery conduit into the underground gasoline storage tank. Since the volume of vapor displaced by gasoline entering the gasoline tank is equal to the volume left vacant by gasoline leaving the storage tank, there is always room in the storage tank for the displaced vapor.

The vacuum-assist system uses a vacuum or other assist means to draw the gasoline vapors into the underground storage tank. The balanced system requires a relatively tight vapor seal at the gasoline inlet opening to prevent any vapor from escaping into the atmosphere. The vacuum-assist system does not require such a tight vapor seal. Since a tight vapor seal is difficult to obtain on some cars, the balanced system is not as efficient as the vacuum-assist system. There are many small stations, however, where the efficiency of a vacuum-assist system is not required.

This invention relates to balanced vapor recovery systems. The problem with presently available balanced systems is that they use a complex heavy nozzle that is hard to handle. It is complex and heavy because it performs several functions. It not only collects vapors, but also opens the vapor conduit before use and closes it after use, and has an interlock to prevent dispensing gasoline unless a good fit is achieved. These functions are necessary in order to force the customer to operate the nozzle properly, to prevent vapors from leaking back out from the underground tank, and to prevent any accidental flame from propagating down the vapor recovery conduit to the underground storage tank.

SUMMARY OF THE INVENTION

In accordance with this invention, the problem of the heavy cumbersome nozzle is solved by eliminating the vapor valve and associated interlocks from the nozzle. The nozzle in this invention has a straight through vapor passage and is only required to collect the gasoline vapors. The vapor valve is placed in the gasoline dispenser away from the nozzle. The vapor valve is opened by an electrical signal when the nozzle is removed from the dispenser or is turned on or off by a signal from a flow sensor in the gasoline dispenser conduit.

The principal advantage of this invention is that it permits the use of a lighter, easier to handle nozzle which has fewer parts that are subject to wear. In this invention, the only parts on the nozzle that are subject to abuse and wear are a rubber boot and soft rubber face which form the vapor seal over the gasoline inlet opening. These low cost components can easily be replaced by inexperienced personnel. The vapor valve has been removed to the dispenser where it is not subject to abuse and wear.

Removal of the vapor valve also permits the use of a conventional nozzle retainer spring to retain the nozzle in the gasoline intake vent during unattended refueling. In the prior art balanced vapor recovery systems, the placement of the vapor valve on the nozzle prevented the use of a retainer spring, and made it necessary to attach buttons or rings to the nozzle spout as retainers. These are relatively hard to engage and are easily dislodged, thereby causing additional problems. The conventional nozzle retainer spring on the other hand, is easy to engage and does not become easily dislodged, and therefore provides a more reliable retaining method.

Another feature of this invention is a detachable soft rubber faceplate that can be easily replaced.

An additional feature of this invention is a long boot with only one inch or less of the nozzle exposed, which eliminates the need for an interlock, and a soft internal spring (e.g. 5 pounds per inch of displacement) which allows the user to achieve a tight vapor seal without having to exert great force on the nozzle.

A further feature of this invention is that the retaining spring on the nozzle permits variable position retention in the vehicle tank.

Yet another feature of the invention is that the invention can be applied to conventional nozzles to convert them for use as vapor recovery nozzles.

DESCRIPTION OF THE DRAWINGS

FIG. 1 is a diagrammatic representation of one embodiment of the invention.

FIG. 2 is a longitudinal sectional view of one nozzle used in this invention.

FIG. 3 is a longitudinal sectional view of an alternate rubber boot for the nozzle of FIG. 2.

DESCRIPTION OF THE PREFERRED EMBODIMENT

FIG. 1 shows the preferred embodiment of the invention. In this embodiment, gasoline 10 is pumped from an underground storage tank 12 by a submersible pump 14 via a rigid conduit 16 and the meter 18 of a gasoline dispenser 20. From meter 18, the gasoline flows via a hose 22 to nozzle 24, and from the nozzle 24 the gasoline flows through the gasoline inlet opening 26 of an automobile and into its gasoline tank 30. Although a submerisible pump 14 is used in this embodiment, the invention is not limited to this type of pump since a suction pump could be used in the dispenser 20 in place of submersible pump 14 if desired.

Nozzle 24 has a resilient rubber sealing boot 32 for making a vapor seal around inlet opening 26 and has an inner channel 34 (FIG. 2) through which gasoline vapor is conducted from the inside of sealing boot 32 through a hose 36 (FIG. 1), valve 38, and rigid conduit 40 to the top of underground tank 12. Hose 36 and rigid conduit 40 form a vapor recovery conduit which extends from nozzle 24 to tank 12. The placement of valve 38 at the junction of hose 36 and rigid conduit 40 rather than in nozzle 24 is an important feature of this invention since it allows nozzle 24 to be lighter, easier to handle, and protects valve 38 from wear and shock due to nozzle use. The placement of valve 38 also permits the use of a conventional retainer spring on nozzle 24 as described hereinafter.

Although valve 38 is shown in the pedestal or island 42 which supports dispenser 20, it could also be located in dispenser 20 if desired. Also, although hose 36 extends through dispenser 20 in the embodiment shown in FIG. 1, it could be connected to valve 38 at a location removed from dispenser 20 if desired.

In this embodiment of the invention valve 38 is a solenoid valve which is actuated electrically by a signal from switch 44 which is turned on when dispenser 20 is turned on and is turned off when dispenser 20 is turned off. Alternately, valve 38 could be actuated either electrically or hydraulically by a flow sensor (not shown) which senses the flow of gasoline somewhere in the gasoline line.

FIG. 2 shows the details of nozzle 24. It consists of a handle 46 through which two channels 34 and 48 pass. Channel 34 is for vapor and channel 48 is for gasoline. A conventional manually actuated valve assembly 50 is connected in series with gasoline channel 48 and is covered by a guard 52. A spout 54 is formed on the end of gasoline channel 48 and serves as the outlet thereof. Spout 54 has a convenional retainer spring 56 attached to its outer end to retain spout 54 in gasoline inlet opening 26 during unattended refueling. The gasoline dispensing portions of nozzle 24 are conventional in structure and will not be described further.

Rubber boot 32 is attached to handle 46 by a clamp 58 and forms an extension of vapor channel 34, which opens into the space between spout 54 and boot 32. Boot 32 has a soft face 60 which is made of nitrile type or neoprene type rubber and is shaped to bear against the surface surrounding gasoline inlet opening 26 to form a vapor seal. A boot extension spring 62 which is attached at its right end in FIG. 2 to boot face 60 and at its left end to boot 32 normally urges boot 32 outwardly and provides pressure for the vapor seal. In the nozzle of this invention, a relatively soft spring 62 is used having a force/deflection ratio in the range of 2 to 7 pounds per inch of deflection which enables the user to achieve a good vapor seal with only light pressure. The prior art nozzle required a force/deflection ratio of 10 pounds per inch of deflection.

Another important feature of the invention is that boot 32 and boot extension spring 62 extend nearly the full length of spout 54, which forces the user to achieve a good vapor seal when spout 54 is inserted into gas inlet opening 26, and thus eliminates the need for an interlock to prevent the gasoline from flowing unless there is a good vapor seal. Spout 54 is only allowed to protrude 1 inch or less from the end of boot 32. In this invention, the long boot automatically provides a good vapor seal when spout 54 is inserted into gas inlet opening 26. Retainer spring 56 provides a secure latch on the seal during unattended refueling.

FIG. 3 shows an alternate boot 64 which has a removable faceplate assembly which includes a soft rubber faceplate 66 which is clamped to boot 64 by a clamp 68.

Having described my invention, I now claim:

1. Gasoline Vapor Recovery System comprising:

a gasoline storage tank;

a pump coupled to said storage tank;

a gasoline dispenser;

a first hose coupled at one end to said dispensers;

means said coupling said first hose through said dispenser to said pump;

a nozzle on the other end of said first hose;

a vapor sealing means on said nozzle for forming a vapor seal around an opening in a receptacle into which gasoline is being pumped through said nozzle;

a vapor recovery conduit extending from said nozzle to of said storage tank, said conduit having a rigid portion which is conected to said storage tank and a hose portion which is connected to said nozzle;

a valve in said vapor recovery conduit, said valve being positioned in said dispenser between the end of said first hose coupled to said dispenser and said pump;

means for opening said valve in response to predetermined conditions to allow gasoline vapors to flow from said receptacle;

said vapor sealing means comprises a resilient boot on said nozzle and spring means for resiliently urging the boot away from said nozzle, said spring having a force/deflection ratio in the range of 2 to 7 pounds per inch of deflection.

2. The combination defined in claim 1 and also comprising a soft resilient face on the outer end of said boot, said face being made of nitrile or neoprene-type rubber.

3. The combination defined in claim 2 and also including means for detachably mounting on said face on boot.

4. The combination defined in claim 1 wherein said boot extends within 1 inch of the outer end of said nozzle.

5. The combination defined in claim 1 and also including means for detachably mounting said boot in said nozzle.

* * * * *